US010689984B2

(12) United States Patent
Varney

(10) Patent No.: US 10,689,984 B2
(45) Date of Patent: Jun. 23, 2020

(54) CAST GAS TURBINE ENGINE COOLING COMPONENTS

(71) Applicant: Rolls-Royce Corporation, Indianapolis, IN (US)

(72) Inventor: Bruce Varney, Greenwood, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 738 days.

(21) Appl. No.: 15/263,663

(22) Filed: Sep. 13, 2016

(65) Prior Publication Data

US 2018/0073371 A1 Mar. 15, 2018

(51) Int. Cl.

| | |
|---|---|
| ***B22D 19/00*** | (2006.01) |
| ***B22D 19/02*** | (2006.01) |
| ***B22D 29/00*** | (2006.01) |
| ***F01D 5/18*** | (2006.01) |
| ***F23R 3/00*** | (2006.01) |
| ***F23R 3/06*** | (2006.01) |
| ***B22C 13/08*** | (2006.01) |
| *F01D 9/04* | (2006.01) |

(52) U.S. Cl.

CPC ..... *F01D 5/187* (2013.01); *B22C 13/085* (2013.01); *F23R 3/002* (2013.01); *F23R 3/06* (2013.01); *F01D 9/041* (2013.01); *F05D 2230/21* (2013.01); *F05D 2260/201* (2013.01); *F05D 2260/202* (2013.01); *F05D 2260/204* (2013.01); *F23R 2900/00018* (2013.01); *F23R 2900/03042* (2013.01); *F23R 2900/03043* (2013.01)

(58) Field of Classification Search

CPC ..... B22D 19/00; B22D 19/02; B22D 29/00; B22D 29/001

USPC ..... 164/91, 98, 112, 131, 132

See application file for complete search history.

(56) References Cited

U.S. PATENT DOCUMENTS

| | | | |
|---|---|---|---|
| 5,640,767 | A | 6/1997 | Jackson et al. |
| 6,172,327 | B1 | 1/2001 | Aleshin et al. |
| 6,199,746 | B1 | 3/2001 | Dupree et al. |
| 6,214,248 | B1 | 4/2001 | Browning et al. |
| 6,575,702 | B2 | 6/2003 | Jackson et al. |
| 6,837,417 | B2 | 1/2005 | Srinivasan |
| 7,051,435 | B1 | 5/2006 | Subramanian et al. |
| 7,146,725 | B2 | 12/2006 | Kottilingam et al. |
| 7,484,928 | B2 | 2/2009 | Arness et al. |
| 7,761,989 | B2 | 7/2010 | Lutz et al. |
| 7,810,237 | B2 | 10/2010 | Lange et al. |

(Continued)

FOREIGN PATENT DOCUMENTS

| | | | |
|---|---|---|---|
| DE | 10319494 | A1 | 11/2004 |
| DE | 102008007820 | A1 | 8/2009 |

(Continued)

*Primary Examiner* — Kevin P Kerns

(74) *Attorney, Agent, or Firm* — Shumaker & Sieffert, P.A.

(57) ABSTRACT

An example system includes a casting mold and a casting core. The casting core includes a substrate. A plurality of support structures integral with and extending from the substrate define a plurality of channels. Respective support structures of the plurality of support structures define respective contact surfaces distal from the substrate. A sacrificial composition substantially fully fills the plurality of cooling channels and leaves the respective contact surfaces substantially uncovered. An example technique includes filling the sacrificial composition in the plurality of cooling channels, and casting a cover layer onto the respective contact surfaces of the plurality of support structures.

13 Claims, 7 Drawing Sheets

(56) References Cited

U.S. PATENT DOCUMENTS

| | | | |
|---|---|---|---|
| 7,966,707 | B2 | 6/2011 | Szela et al. |
| 8,070,450 | B1 | 12/2011 | Ryznic et al. |
| 8,087,565 | B2 | 1/2012 | Kottilingam et al. |
| 8,247,733 | B2 | 8/2012 | Zhu |
| 8,356,409 | B2 | 1/2013 | Perret |
| 8,528,208 | B2 | 9/2013 | Rebak et al. |
| 8,539,659 | B2 | 9/2013 | Szela et al. |
| 8,555,500 | B2 | 10/2013 | Vossberg et al. |
| 8,739,404 | B2 | 6/2014 | Bunker et al. |
| 8,875,392 | B2 | 11/2014 | Richter |
| 9,476,306 | B2 | 10/2016 | Bunker et al. |
| 2004/0086635 | A1 | 5/2004 | Grossklaus, Jr. et al. |
| 2005/0217110 | A1 | 10/2005 | Topal |
| 2006/0120869 | A1 | 6/2006 | Wilson et al. |
| 2007/0044306 | A1 | 3/2007 | Szela et al. |
| 2007/0163684 | A1 | 7/2007 | Hu |
| 2008/0011813 | A1 | 1/2008 | Bucci et al. |
| 2009/0026182 | A1 | 1/2009 | Hu et al. |
| 2009/0194247 | A1 | 8/2009 | Kriegl |
| 2009/0255116 | A1 | 10/2009 | McMasters et al. |
| 2009/0324841 | A1 | 12/2009 | Arrell et al. |
| 2012/0179285 | A1 | 7/2012 | Melzer-Jokisch et al. |
| 2012/0222306 | A1 | 9/2012 | Mittendorf et al. |
| 2014/0003948 | A1 | 1/2014 | Dubs et al. |
| 2014/0169943 | A1 | 6/2014 | Bunker et al. |
| 2014/0259666 | A1 | 9/2014 | Baughman et al. |
| 2015/0047168 | A1 | 2/2015 | James et al. |
| 2018/0093354 | A1 | 4/2018 | Cui et al. |

FOREIGN PATENT DOCUMENTS

| | | | |
|---|---|---|---|
| DE | 102008058140 | A1 | 5/2010 |
| EP | 1584702 | A1 | 10/2005 |
| EP | 1803521 | A1 | 7/2007 |
| EP | 1880793 | A2 | 1/2008 |
| EP | 1884306 | A1 | 2/2008 |
| EP | 2206575 | A1 | 7/2010 |
| EP | 2578720 | A2 | 4/2013 |
| WO | 2012092279 | A1 | 7/2012 |

CAST GAS TURBINE ENGINE COOLING COMPONENTS

TECHNICAL FIELD

The present disclosure relates to casting a cooled component of a gas turbine engine component.

BACKGROUND

Hot section components of a gas turbine engine may be operated in high temperature environments that may approach or exceed the softening or melting points of the materials of the components. Such components may include air foils including, for example turbine blades or vanes which may have one or more surfaces exposed high temperature combustion or exhaust gases flowing across the surface of the competent. Different techniques have been developed to assist with cooling of such components including, for example, application of a thermal barrier coating to the component, construction the component as single or dual wall structure, and passing a cooling fluid, such as air, across or through a portion of the component to aid in cooling of the component. Maintaining the efficiency and operation of such cooling systems is useful to facilitate engine performance and prevent over heating of the engine.

SUMMARY

In some examples, the disclosure describes an example system including a casting mold and a casting core. The casting core includes a substrate. A plurality of support structures integral with and extending from the substrate define a plurality of channels. Respective support structures of the plurality of support structures define respective contact surfaces distal from the substrate. A sacrificial composition substantially fully fills the plurality of cooling channels and leaves the respective contact surfaces substantially uncovered.

In some examples, the disclosure describes an example technique including filling a sacrificial composition in a plurality of cooling channels on a substrate. A plurality of support structures integral with and extending from the substrate define the plurality of cooling channels. Respective support structures of the plurality of support structures define respective contact surfaces distal from the substrate. The sacrificial composition substantially fully fills the plurality of cooling channels and leaves the respective contact surfaces substantially uncovered. The example technique includes casting a cover layer onto the respective contact surfaces of the plurality of support structures.

The details of one or more examples are set forth in the accompanying drawings and the description below. Other features, objects, and advantages will be apparent from the description and drawings, and from the claims.

DETAILED DESCRIPTION

Figure 1A:
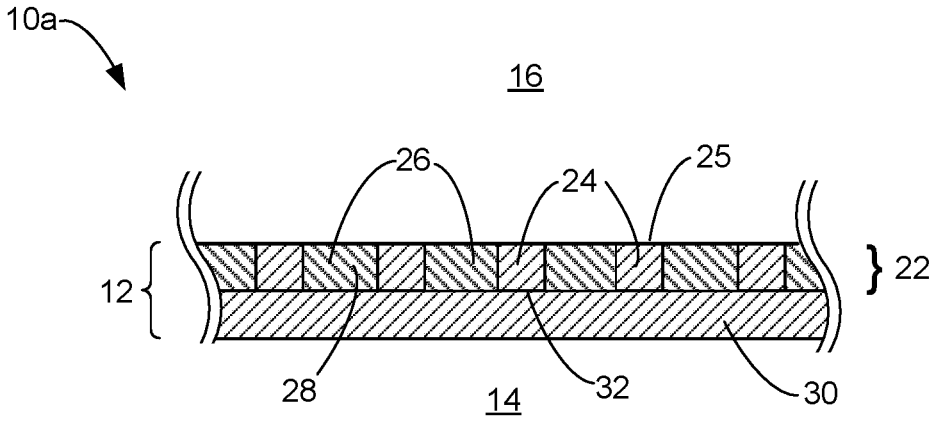
FIG. 1A is a conceptual cross-sectional view of an example system including a casting core including a substrate defining a plurality of cooling channels and a sacrificial composition filling the plurality of cooling channels.

The disclosure generally describes gas turbine engine components configured to separate a cooling air plenum from a heated gas environment, in which the gas turbine engine component includes a substrate, support structures integral with and extending form the substrate, and a cover layer cast onto the support structures. The cover layer may define a hot wall surface configured to face the heated gas environment. The cooling region may be disposed between the cover layer and the substrate and includes a plurality of support structures extending between the cover layer and the surface of the substrate. By casting the cover layer onto the support structures, a good metallurgical bond may be formed between the cover layer and the substrate, for example, resulting in material properties comparable to those of integrally cast structures.

Hot section components, such as turbine surfaces, air foils, and flame tubes of a combustor of a gas turbine engine may be operated in high temperature gaseous environments. In some examples, the temperature of the gaseous environments may approach or exceed the melting point or softening point of a material from which at least a portion of the component is formed. For example, operating temperatures in a high pressure turbine section of a gas turbine engine may exceed melting or softening points of superalloy materials used in the high pressure turbine section, e.g., to form substrates of blades or vanes.

In some examples, to reduce or substantially prevent melting or softening of the engine components, the components may include a dual wall structure having a hot wall (e.g., coversheet), a cold wall (e.g., substrate), and a cooling region between the hot wall and the cold wall. The cooling region may include support structures between the hot wall and the cold wall. In some examples, the cooling system may function by flowing relatively cold air from the compressor section of the gas turbine engine through cooling channels in the cooling region of the dual wall structure. These cooling channels may exhaust some or all of the cooling air through cooling apertures in the surface of the hot wall. In some examples, the cooling air may help protect the component in such high temperature gaseous environments by, for example, reducing the relative temperature of the component, creating an insulating film of cooling air passing over the surface of the component exposed to the high temperature environment, or reducing the temperature of the gas within the high temperature environment. Dual wall structures may also reduce cooling airflow needs compared to a single wall structure, so that a greater volume of the airflow is available for operation of the turbine, for example, for combustion.

Support structures may include features such as pins, fins, pedestals, or the like between the hot wall and the cold wall in the dual wall structure. In some examples, the support structures also function as cooling features, the dual wall structure may include additional cooling features (such as cooling channel) between the hot wall and the cold wall, or both. Such cooling features may improve the effectiveness of cooling, for example, by providing additional surface area for convective cooling, by increasing conduction area to draw heat away from the hot wall, by routing cooling air through the space between the hot wall and cold wall in selected flow patterns, or the like. In some examples, the effectiveness of the cooling features may increase as the cooling features are made finer due to an increase in exposed surface area to volume of the cooling features.

While techniques such as integral casting, diffusion bonding, and machining may be used to fabricate dual wall structures, these techniques have drawbacks. For example, integral casting with ceramic cores may utilize ceramic cores with very fine features, which are difficult to reliably and repeatably form, may have low manufacturing yields, may have limitations on feature size, and may present difficulties in inspecting support structures and cooling features between the hot wall and the cold wall to check for defects, blockages, or other failures. Using refractory metal cores may present similar difficulties in inspecting the support structures and cooling features to check for defects, blockages, or other failures.

Diffusion bonding of separate spars and coversheets may present higher costs and increased complexity because of additional machining of castings prior to diffusion bonding and the use of multiple castings. Additionally, in some examples, bonding cycles may lead to some loss in material capability. While DMLS (direct metal laser sintering) may be used to fabricate separate cover sheets on spars having cooling features, the resulting components may have reduced material properties compared to single crystal alloys used in hot section components, for example, because of geometric discontinuities or compositional differences between separately fabricated cover sheets and spars. Aligning cooling holes in the hot wall with the underlying cooling pattern also may be difficult when fabricating the hot wall separately from the cold wall then joining the hot wall and cold wall.

In some examples according to the disclosure, rather than diffusion bonding a separate coversheet to a spar, integrally casting the coversheet and spar, or forming a coversheet on a spar using DMLS, a cover layer may be casted onto a casting core that includes a substrate and integrated support structures. In some examples, an example system may include a casting mold and a casting core. The casting core includes a substrate. The casting core also includes a plurality of support structures integral with and extending from the substrate, which define a plurality of channels. Respective support structures of the plurality of support structures define respective contact surfaces distal from the substrate. A sacrificial composition substantially fully fills the plurality of cooling channels and leaves the respective contact surfaces substantially uncovered. In some examples according to the disclosure, an example technique may include filling the sacrificial composition in the plurality of cooling channels, and casting a cover layer onto the respective contact surfaces of the plurality of support structures.

The disclosed examples and techniques described herein may be used to manufacture dual wall structures with, in various examples, intricate or fine cooling features, having higher yields compared to integral casting, having lower costs than diffusion bonded constructions, and/or providing better alignment between cooling holes in the hot wall and support structures or cooling features. In some examples, if the substrate comprises a material, for example, a single crystal alloy, and the cover layer is cast from the same material, the cover layer may integrate sufficiently well at the contact surfaces of the plurality of support structures to result in a structure having material capabilities comparable to those of integrally cast structures. Thus, while material properties associated with integrally cast structures may be obtained while avoiding problems associated with integral casting such as low manufacturing yields, limitations on feature size, and difficulties in inspecting support structures and cooling features between the hot wall and the cold wall to check for defects, blockages, or other failures, may be avoided.

FIG. 1A is a conceptual cross-sectional view of an example system 10*a* including a casting core including a substrate 12 defining a plurality of cooling channels 26 and a sacrificial composition 28 filling the plurality of cooling channels 26.

System 10*a* includes a casting mold (not shown) and a casting core 12. Casting core 12 is a precursor of a component configured to separate a cooling air plenum 14 from a heated gas environment 16 such that the component acts as a physical separation between the two environments.

In some examples, the component may include a hot section component for a gas turbine engine that receives or transfers cooling air as part of cooling system for a gas turbine engine. The component may include, for example, components of a combustor such as a flame tube, combustion ring, the inner or outer casing, liner, guide vane, or the like; components of a turbine section such as a nozzle guide vane, a turbine disc, a turbine blade, or the like; or another component associated with the air-cooling system of a gas turbine engine. In some examples, the component may be constructed with a castable material, for example, a metal or alloy material, a superalloy substrate, or other materials used, for example, in the aviation or aerospace industry. However, the component may be formed of suitable materials other than those mentioned above.

Cooling air plenum 14 and heated gas environment 16 may represent different flow paths, chambers, or regions within the gas turbine engine in which the component is installed. For example, in some examples in which the component is a flame tube of a combustor of a gas turbine engine, heated gas environment 16 may comprise the combustion chamber within the flame tube and cooling air plenum 14 may be the by-pass/cooling air flow path that surrounds the exterior of the flame tube. In some examples in which the component is a turbine blade or vane, heated gas environment 16 may represent the environment exterior to and flowing past the turbine blade or vane while cooling air plenum 14 may include one or more interior chambers within the turbine blade or vane representing part of the integral cooling system of the gas turbine engine.

Casting core 12 includes a cooling region 22 and a substrate 30. In some examples, cooling region 22 may be defined as a region including structures disposed on and attached to a major surface 32 of the substrate 30. While in example system 10*a* of FIG. 1A, major surface 32 is an interface between cooling region 22 and substrate 30, in other examples, structures in cooling region 22 may be integrally formed with substrate 30, and major surface 32 may not define an interface between cooling region 22 and substrate 30.

Figure 1B:
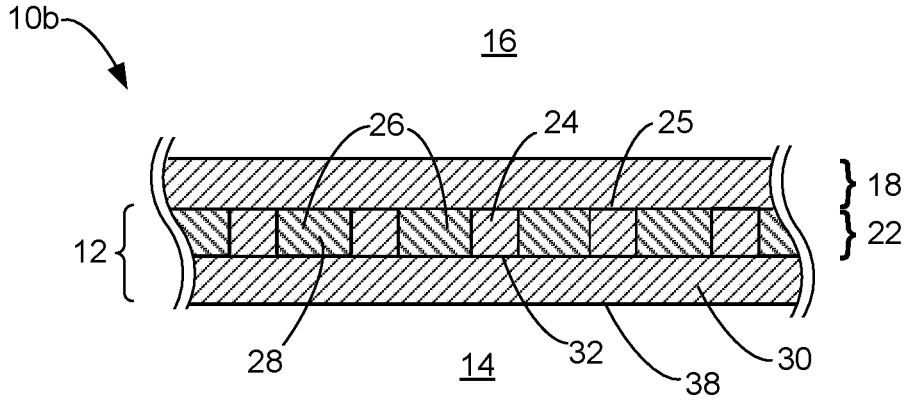
FIG. 1B is conceptual cross-sectional view of the example system of FIG. 1A further including a cover layer.

Cooling region 22 may include a plurality of support structures 24. The plurality of support structures 24 may define a network of the plurality of cooling channels 26. In some examples, the plurality of support structures 24 may be integral with and extend from substrate 30. For example, substrate 30 and plurality of support structures 24 may be formed in a single casting technique. In some examples, cooling region 22 is bonded to substrate 30, for example, at respective bond surfaces 32 defined by cooling region 22, e.g., at respective bases of the plurality of support structures 24 opposite of cover layer 18 (FIG. 1B).

Respective support structures of the plurality of support structures 24 may define respective contact surfaces 25 distal from substrate 30. In some examples, the plurality of support structures 24 may include one or more of pedestals, columns, spires, raised features, or channel walls. The plurality of support structures 24 also may function as cooling features, e.g., for conducting heat from cover layer 18 toward substrate 30. In some examples, cooling region 22 may include one or more additional cooling features, such as the plurality of cooling channels 26. The plurality of support structures 24 and, optionally, other cooling features, may take on any useful configuration, size, shape, or pattern. In some such examples, the height of plurality of support structures 24 may be between about 0.25 mm and about 7 mm to define the thickness of cooling region 22.

In some examples, the plurality of support structures 24 may include a corrugated structure that defines the plurality of cooling channels 26 between the respective walls of the corrugated structure. In some examples, the plurality of support structures 24 may also include one or more dams that act as zone dividers within the cooling region 22 thereby separating one cooling channel of the plurality of cooling channels 26 from another cooling channel of the plurality of cooling channels 26. The introduction of dams within cooling region 22 may assist with maintaining a more uniform temperature along hot wall surface 20 by controlling flow of cooling air within the plurality of cooling channels 26. Thus, in some examples, the plurality of support structures 24 provides a conduit for heat transfer across hot wall surface 20 of cover layer 18 and cooling region 22 between cooling air plenum 14 and heated gas environment 16, as part of the air-cooling system for a gas turbine engine.

In some examples, casting core 12 includes a sacrificial composition 28 substantially fully filling respective cooling channels of the plurality of cooling channels 26. Sacrificial composition 28 may leave uncovered respective contact surfaces 25 defined by respective support structures of the plurality of support structures 24, and leave the respective contact surfaces 25 substantially uncovered. In some examples, cooling region 22 presents a substantially smooth receiving contact surface for receiving a material cast onto casting core 12, for example, including surfaces defined by respective portions of sacrificial composition 28 filling the plurality of cooling channels 26 and respective contact surfaces 25 of the plurality of support structures 24. Thus, on casting material over casting core 12 to form a casted structure connected to casting core 12, the casted structure may define a substantially smooth surface facing cooling region 22. For example, cover layer 18 may be cast over casting core 12, and a surface of cover layer 18 facing cooling region 22 may be substantially smooth.

In some examples, sacrificial composition 28 is susceptible to at least one of leaching or oxidation. Sacrificial composition 28 is removable from the plurality of cooling channels 26, for example, by subjecting sacrificial composition 28 to at least one of a leaching composition or an oxidizing environment. In some examples, sacrificial composition 28 comprises one or more of ceramic, metal, alloys, or other suitable refractory material. In some examples, sacrificial composition 28 is thermally stable at least at temperatures at which a material may be cast onto casting core 12. In some examples, sacrificial composition 28 is thermally stable at least at temperatures greater than a melting point of material in cover layer 18. For example, sacrificial composition 28 may be thermally stable at temperatures up to at least 1300° C. (2370° F.).

FIG. 1B is conceptual cross-sectional view of example system 10*b* that is similar to system 10*a* of FIG. 1A, further including a cover layer 18. Cooling region 22 of casting core 12 may be disposed adjacent substrate 30 such that cover layer 18 adjacent cooling region 22 faces heated gas environment 16 and substrate 30 faces cooling air plenum 14. As such, in some examples, substrate 30 may be referred to as a cold wall and cover layer 18 may be referred to as a hot wall. In some examples, one or both of cover layer 18 and substrate 30 may define a thickness between about 0.014 inches and about 0.300 inches (e.g., about 0.36 mm to about 7.62 mm). In some examples, cooling region 22 may have a thickness between about 0.25 mm and about 7 mm.

Cover layer 18 defines a hot wall surface 20 configured to face heated gas environment 16. Substrate 30 defines a cold wall surface 38 configured to face cooling air plenum 14. The terms "cold wall surface" and "hot wall surface" are used merely to orient which wall is adjacent to cooling air plenum 14 and which wall is adjacent to heated gas environment 16, respectively, and are not intended to limit the relative temperatures of the different environments or wall. For example, while cold wall surface 38 and cooling air plenum 14 may be described as "cold" sections compared to hot wall surface 20 and heated gas environment 16, the respective temperatures of cold wall surface 38 or cooling air plenum 14 may reach temperatures between about 390° F. to about 1830° F. (e.g., about 200° C. to about 1000° C.) during routine operation.

Figure 1C:
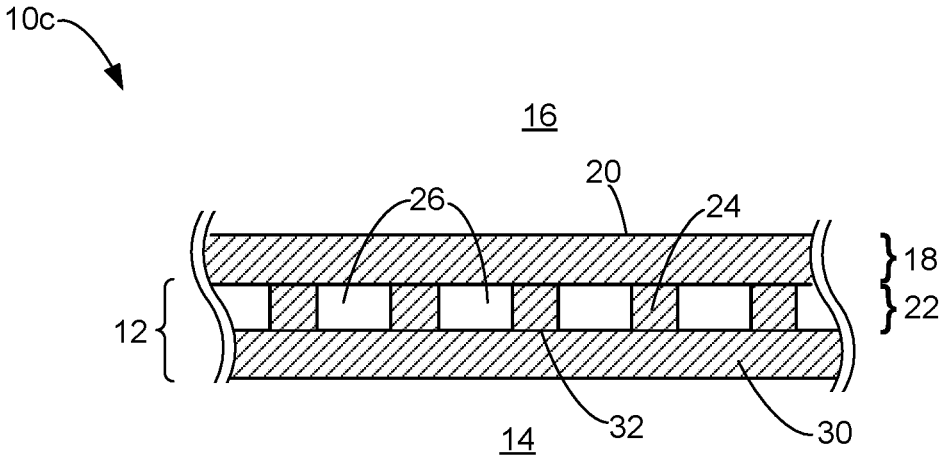
FIG. 1C is conceptual cross-sectional view of the example system of FIG. 1B with the sacrificial composition removed.

FIG. 1C is conceptual cross-sectional view of example system 10*c*, which is similar to example system 10*b* of FIG. 1B, with sacrificial composition 28 substantially removed from the plurality of cooling channels 26 in cooling region 22 of casting core 12. In some examples, sacrificial composition 28 may be removed after cover layer 18 is cast onto casting core 12. For example, sacrificial composition 28 may be removed from casting core 12 to obtain a gas turbine engine cooling component. The efficiency of heat transferred from heated gas environment 16 to cooling air plenum 14 across cooling region 22 in the gas turbine engine cooling component may depend on a variety of factors including, but not limited to, the total area of hot wall surface 20 of cover layer 18, the surface area defined by plurality of support structures 24 and plurality of cooling channels 26, the thermal conductivity of substrate 30, the total area of cold wall surface 38, the thermal conductivity at bond surface 32, and the size of cooling channels of the plurality of channels 26.

Figure 2A:
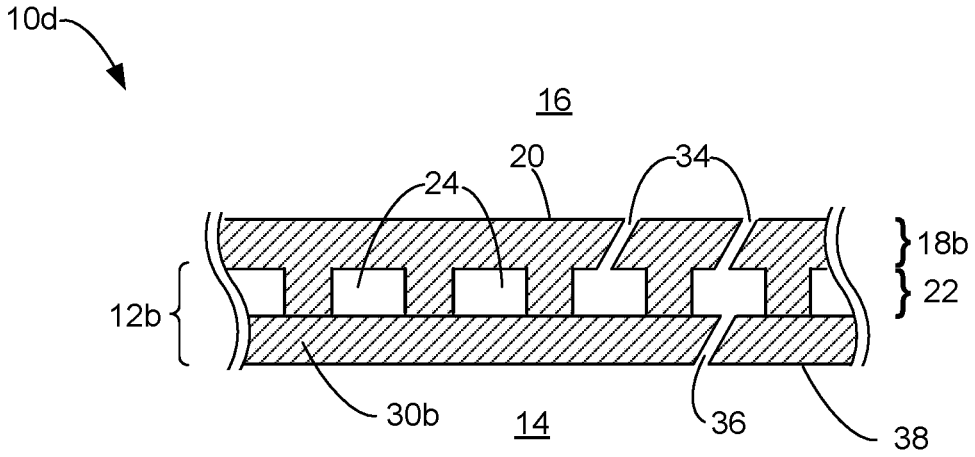
FIG. 2A is a conceptual cross-sectional view of the example system of FIG. 1C including a cover layer defining cooling apertures.
Figure 2B:
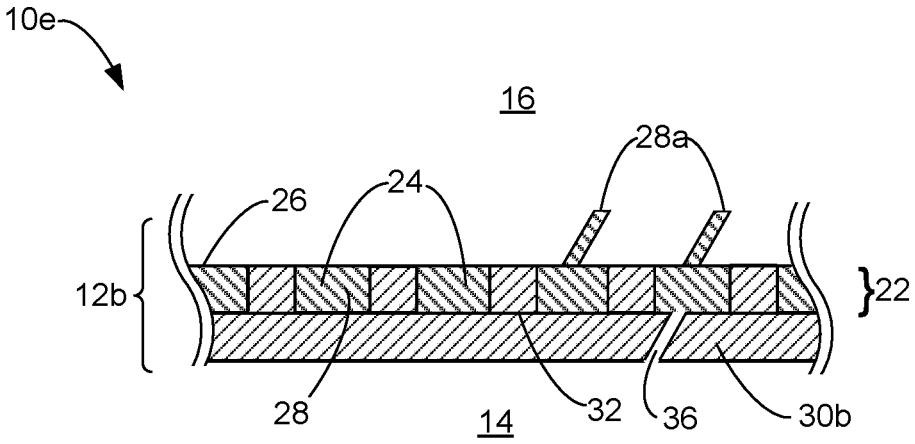
FIG. 2B is a conceptual cross-sectional view of an example system including a casting core including a substrate defining a plurality of cooling channels and a sacrificial composition filling the plurality of cooling channels.
Figure 2C:
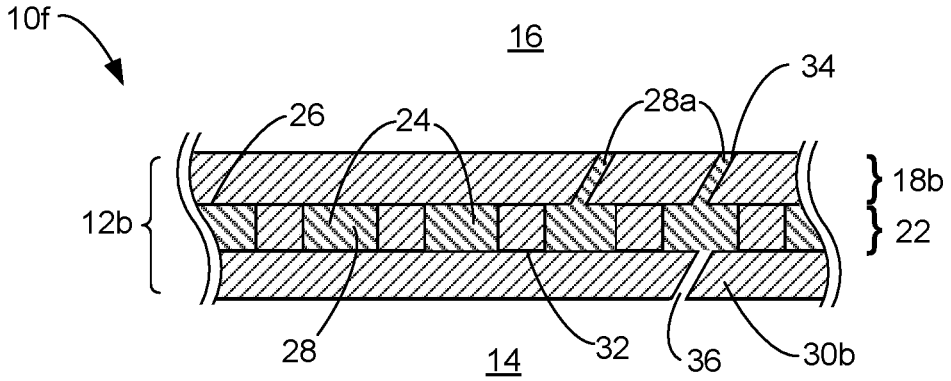
FIG. 2C is conceptual cross-sectional view of the example system of FIG. 2B further including a cover layer.

In some examples, a cover layer 18*b* may define a plurality of cooling apertures 34, as shown in FIG. 2A. FIG. 2A is a conceptual cross-sectional view of an example system 10*d* similar to system 10*c* of FIG. 1C, further including cooling apertures 34 in cover layer 18*b*. In some examples, cooling apertures 34 may be formed by machining cover layer 18*b*, for example, by drilling cooling apertures 34 into cover layer 18*b*. In other examples, cooling apertures 34 may be defined by protrusions 28*a* of respective portions of sacrificial composition, as shown in FIGS. 2B and 2C. FIG. 2B is conceptual cross-sectional view of an example system 10*e*, which can be used to form system 10*d* of FIG. 2A. Casting core 12*b* of system 10*e* may include sacrificial composition 28 substantially filling the plurality of cooling channels 24 and exhibiting respective protrusions 28*a*. On casting material for forming cover layer 18*b* over casting core 12*b*, protrusions 28*a* will define respective cooling apertures 34, as shown in FIG. 2C. FIG. 2C is conceptual cross-sectional view of an example system 10*f*, which is similar to system 10*e* of FIG. 2B, further including cover layer 18*b* cast on casting core 12*b*. System 10*d* of FIG. 2A can be obtained, for example, by removing sacrificial composition 28 from casting core 12*b* of system 10*f*.

Unlike cover layer 18 of FIG. 1, cover layer 18*b* defines the plurality of cooling apertures 34. Cooling apertures 34 may extend between cooling region 22 and hot wall surface 20. In some examples, a substrate 30*b* of system 10*d* may be substantially similar to substrate 30 discussed with reference to FIG. 1A above. However, unlike substrate 30 of FIG. 1, substrate 30*b* may define a plurality of impingement apertures 36 extending between cooling region 22 and cold wall surface 38. In some examples, the diameter of one or both of plurality of cooling apertures 34 and impingement apertures 36 may be between about 0.01 inches and about 0.12 inches (e.g., about 0.25 mm to about 3 mm). Thus, in some examples, system 10*b* may be substantially similar to system 10*a* discussed above with reference to FIG. 1A, while further including one or both of plurality of cooling apertures 34 or plurality of impingement apertures 36.

During operation of a component including an article including casting core 12 or 12*b* and cover layer 18 or 18*b*, the temperature of the air within cooling air plenum 14 may be less than that of the hot gas environment 16. During operation of the component, cooling air may pass from cooling air plenum 14 to heated gas environment 16 through one or both of the plurality of cooling apertures 34 or the plurality of impingement apertures 36. The cooling air may assist in maintaining the temperature of the component at a level lower than that of heated gas environment 16. For example, the cooling air may enter heated gas environment 16 creating an insulating film of relatively cool gas along hot wall surface 20 that allows hot wall surface 20 of the component to remain at a temperature less than that of the bulk temperature of heated gas environment 16. In some examples, the cooling air may also at least partially mix with the gas of heated gas environment 16, thereby reducing the relative temperature of heated gas environment 16. In some examples, the cooling region 22 may create a zoned temperature gradient between the respective regions of cooling air plenum 14 and heated gas environment 16. Additionally, or alternatively, the cooling gas may act as a cooling reservoir that absorbs heat from the component as the gas passes through cooling apertures 34 or along one or more of the surfaces of the component, thereby dissipating the heat of the component and allowing the relative temperature of component to be maintained at a temperature less than that of heated gas environment 16.

In some examples, the cooling air may be supplied to the component (e.g., via cooling air plenum 14) at a pressure greater than the gas path pressure within heated gas environment 16. The pressure differential between cooling air plenum 12 and heated gas environment 16 may force cooling air 18 through the plurality of cooling apertures 34. In some examples, the plurality of cooling apertures 34 may include film cooling holes that are shaped to reduce the use of cooling air. The plurality of cooling apertures 34 may be positioned in any suitable configuration and position about the surface of the component. For example, the plurality of cooling apertures 34 may be positioned along the leading edge of a gas turbine blade or vane. In some examples, the plurality of cooling apertures 34 may define incidence angle less than 90 degrees, i.e., non-perpendicular, to hot wall surface 20. In some examples the angle of incidence may be between about 10 degrees and about 75 degrees to hot wall surface 20 of system 10*d*. In some such examples, adjusting the angle of incidence of hot wall surface 20 may assist with creating a cooling film of the cooling air along hot wall surface 20. Additionally, or alternatively, one or more of the plurality of cooling apertures 34 may include a fanned Coanda ramp path at the point of exit from hot wall surface 20 to help assist in the distribution or film characteristics of the cooling air as it exits a respective cooling aperture of the plurality of cooling apertures 34.

System 10*c* or system 10*d* may be fabricated using example techniques and example systems, as described with reference to FIGS. 6A, 6B, 6C, and 7. For example, casting core 12 including sacrificial composition 28 may be placed in a casting mold or shell. A casting composition, for example, a molten alloy composition may be poured onto the casting core in the casting shell. The casting composition may cool and solidify to form a cast component. The cast component may be removed from the casting mold. The cast component may be subjected to a post-casting treatment to remove sacrificial composition 28 from casting core 12. Thus, in some examples, gas turbine engine components, for example, a dual wall component including include system 10*c* or system 10*d*, may be fabricated using example techniques according to the disclosure. For example, substrate 30 may include a spar, and cover layer 18 or 18*b* may include a coversheet for the spar.

Figure 3:
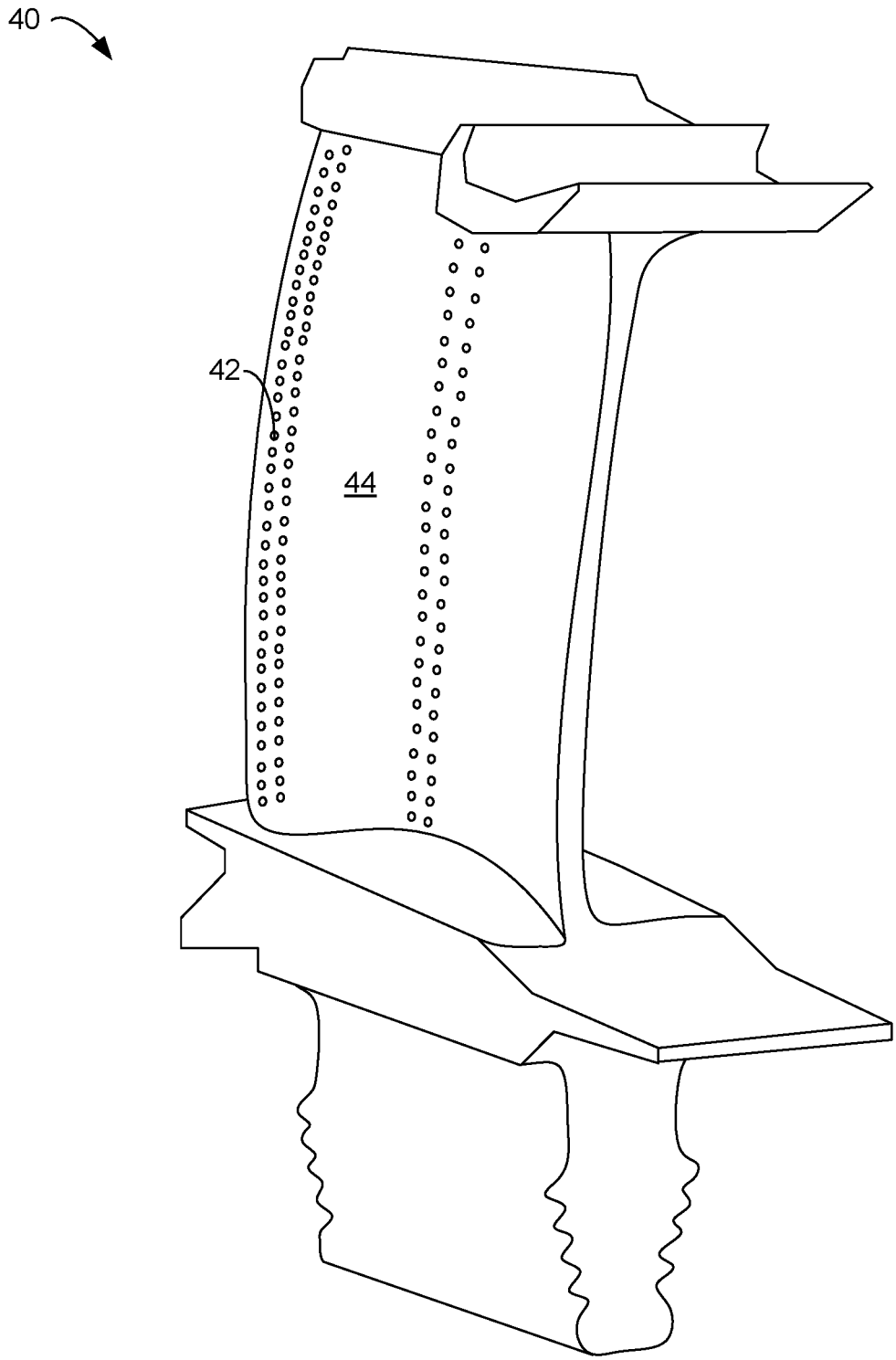
FIG. 3 is a conceptual diagram of an example turbine airfoil component for use in a gas turbine engine.
Figure 4:
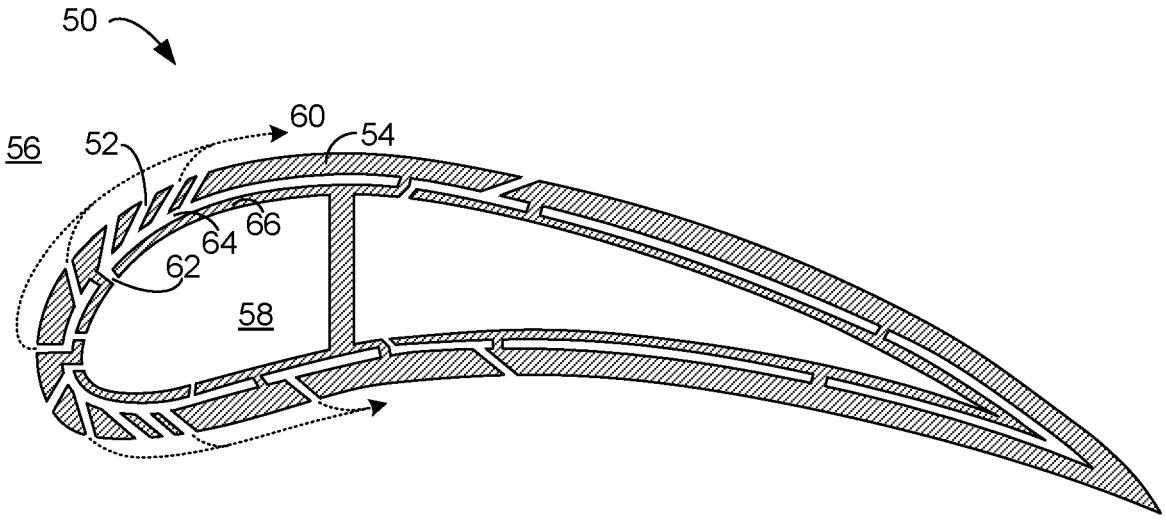
FIG. 4 is a conceptual cross-sectional view of an example dual walled turbine blade for use in a gas turbine engine.

FIG. 3 is a conceptual diagram of an example turbine airfoil component (e.g., turbine blade or vane) for use in a gas turbine engine. FIG. 3 illustrates an example turbine airfoil 40 that includes a plurality of cooling apertures 42 arranged on a hot section wall surface 44 of the airfoil. Turbine airfoil 40 may be a dual or multi-walled structure as described above with respect to FIGS. 1C and 2A. For example, FIG. 4 illustrates a cross-sectional view of an example dual wall turbine airfoil 50 that includes a plurality of cooling apertures 52 along a hot section wall 54 and a plurality of impingement apertures 62 along a cold section wall 66. In some examples, dual wall turbine airfoil 50 may have substantially the same structural configuration as system 10*c* or system 10*d*, for example, including a cooling region including a plurality of support structures extending between hot section wall 54 and cold section wall 66. As shown, cooling air 60 may flow from cooling air plenum 58 through impingement apertures 62 into cooling channels 64 before exiting through cooling apertures 52 into heated gas environment 56.

Figure 5:
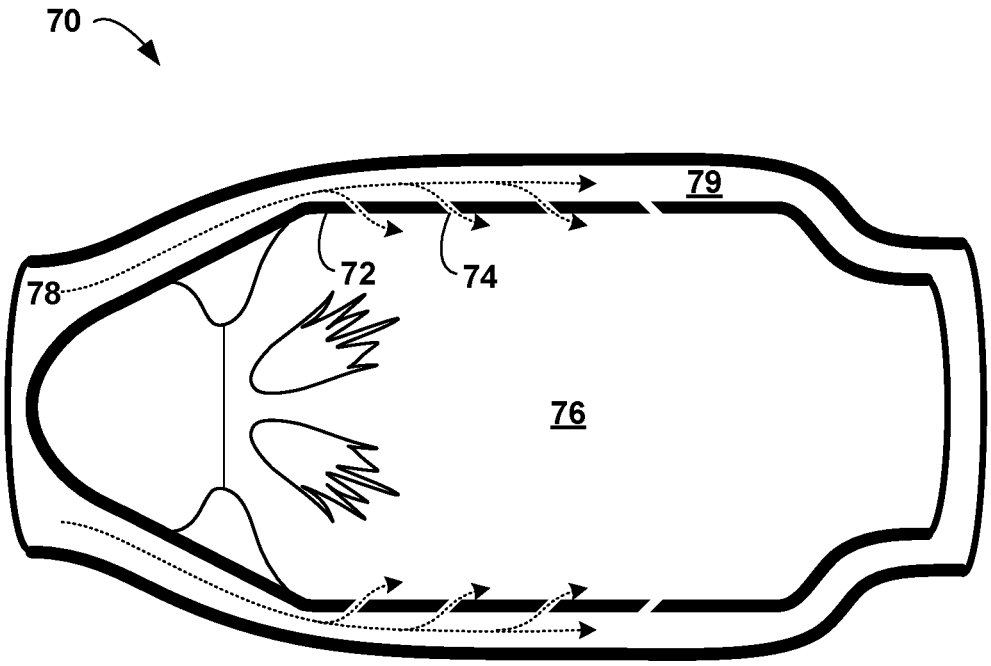
FIG. 5 is a cross-sectional view of an example combustor that includes a flame tube with a sidewall.

FIG. 5 illustrates a cross-sectional view of an example combustor 70 that includes a flame tube 72 (e.g., combustion chamber) with a sidewall defining a plurality of cooling apertures 74. In some examples, the gases within the combustor post combustion, (e.g., heated gas environment 76) may exceed about 1,800° C., which may be too hot for introduction against the vanes and blade of the turbine (e.g., FIGS. 3 and 4). In some examples, the combusted gases may be initially cooled prior to being introduced against the vanes and blade of the turbine by progressively introducing portions of the by-pass air (e.g., cooling air 78) into heated gas environment 76 of flame tube 72 via ingress through plurality of cooling apertures 74 strategically positioned around flame tube 72, fluidly connecting cooling air 78 within cooling air plenum 79 with heated gas environment 76.

In some examples, combustor 70 includes a dual wall structure having substantially the same structural configuration as system 10*c* or system 10*d*, for example, including a cooling region including a plurality of support structures extending between a surface adjacent heated gas environment 76 and a surface adjacent cooling air 78. In some example, cooling air 78 may intimately mix with the combusted gases to decease the resultant temperature of the volume of heated gas environment 76. Additionally, or alternatively, cooling air 78 may form an insulating cooling air film along the interior surface (e.g., hot section surface) of flame tube 72. In some examples, the wall of flame tube may include a dual wall (e.g., system 10*c* or system 10*d*) structure.

Figure 6A:
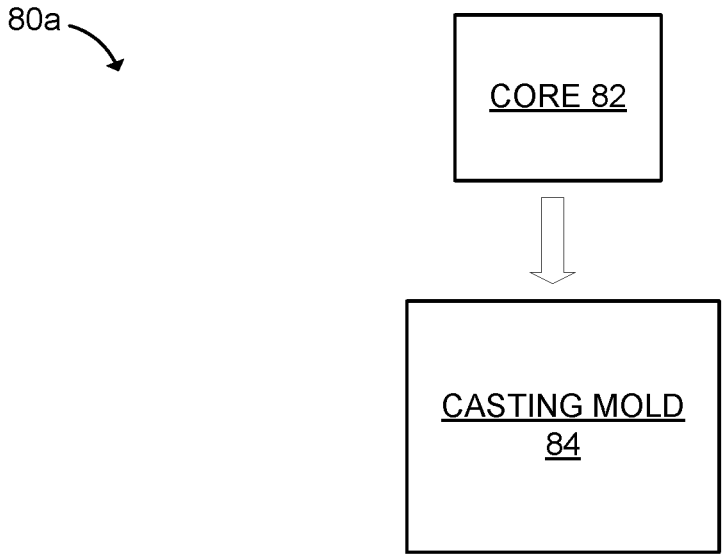
FIGS. 6A, 6B, and 6C are schematic and conceptual block diagrams of configurations of an example assembly for fabricating a gas turbine engine component by casting a molten alloy composition in in a shell including a core.
Figure 6B:
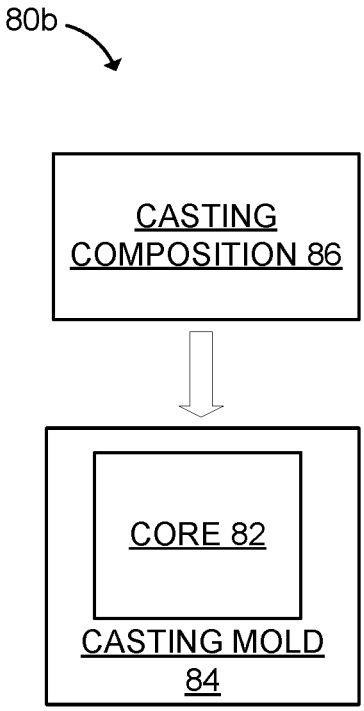
Figure 6C:
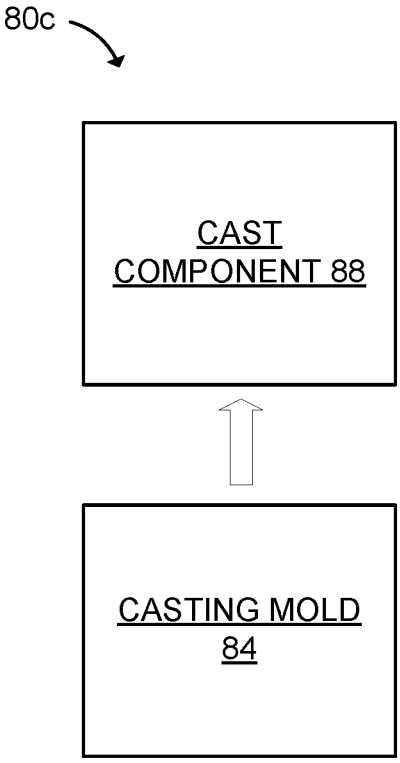

FIGS. 6A, 6B, and 6C are schematic and conceptual block diagrams of respective configurations 80*a*, 80*b*, and 80*c* of an example assembly for fabricating a gas turbine engine component by casting a casting composition 86 in a casting mold 84 (or shell). Casting core 82 (for example, similar to casting core 12 in system 10*a* or casting core 12*b* in system 10*e*) including a sacrificial composition 28 may be placed in casting mold 84 (FIG. 6A). Casting composition 86 then may be introduced into casting mold 84 (FIG. 6B). Casting composition 86 may include a suitable composition that may be melted and cast, for example, a molten alloy composition. In some examples, casting composition 86 may include a metal or alloy that is substantially the same as metal or alloy in substrate 30 or substrate 30*b*. In some examples, the metal or alloy may include a cobalt-based alloy, or a nickel-based alloy, for example, a nickel superalloy. In some examples, casting composition 86 may be poured onto casting core 82 in casting mold 84.

Casting composition 86 may cool and solidify to form a cast component 88, for example, including cover layer 18 or 18*b*. Cast component 88 may be removed from casting mold 84 (FIG. 6C). The system of FIGS. 6A, 6B, and 6C may be operated and controlled manually, for example, by an operator, or automatically, for example, using a computer or a computerized controller. Cast component 88 may be subjected to a post-casting treatment to substantially remove sacrificial composition 28 from casting core 82, to produce an article including a cover layer, a cooling region, and a substrate, for example system 10*c* or system 10*d* described with reference to FIGS. 1C and 2A, respectively. Thus, the example system of FIGS. 6A, 6B, and 6C may be used to cast cover layer 18 onto casting core 12 or cover layer 18*b* onto casting core 12*b*.

Figure 7:
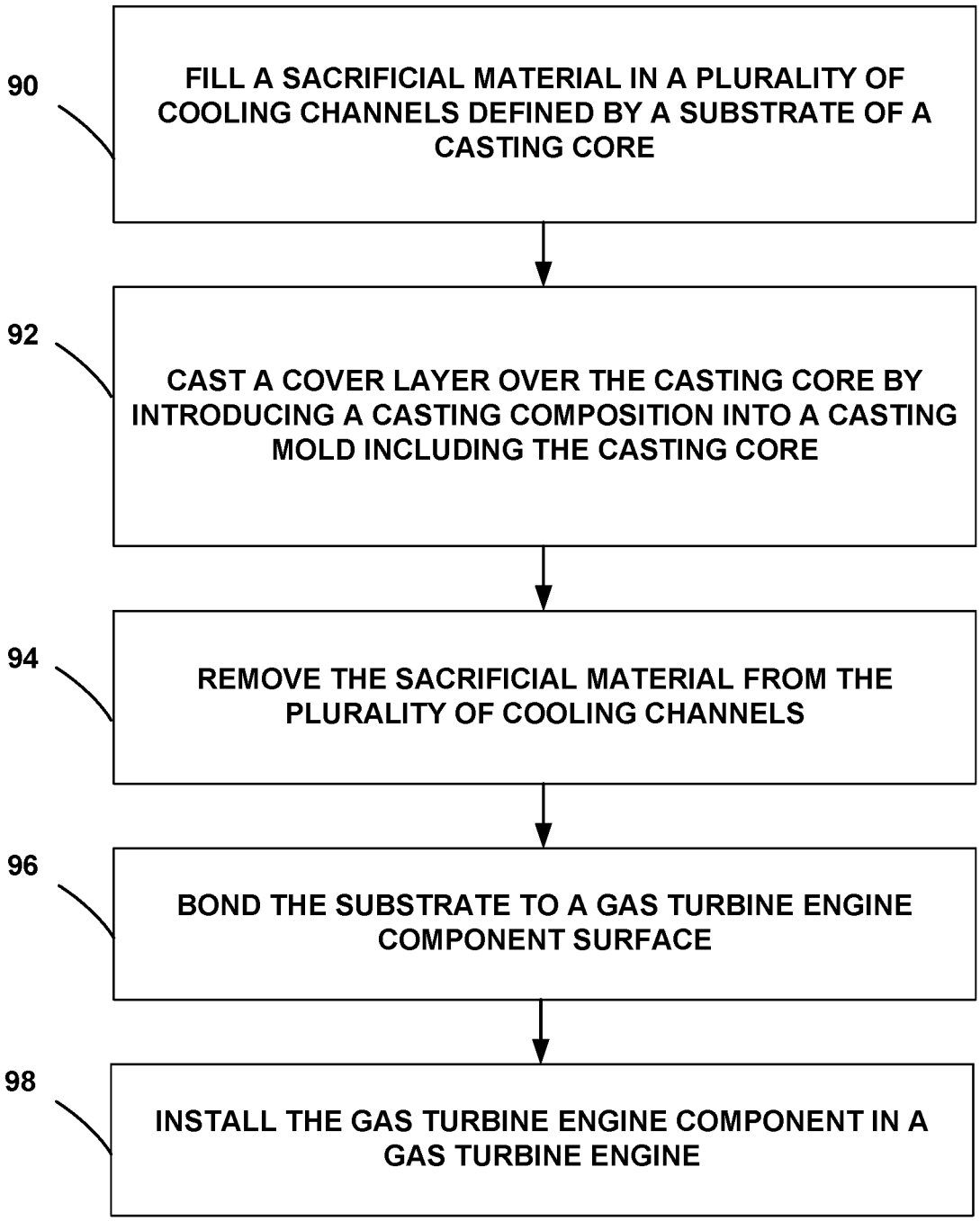
FIG. 7 is a conceptual flow chart of an example technique for fabricating a gas turbine engine component by casting.

FIG. 7 is a conceptual flow chart of an example technique for fabricating a gas turbine engine component that includes cover layer 18 or cover layer 18*b* adjacent cooling region 22 on substrate 30 or substrate 30*b*. The example technique may include filling sacrificial composition 28 in the plurality of cooling channels 26 on substrate 30 or substrate 30*b* (90). The plurality of support structures 24 integral with and extending from substrate 30 define the plurality of cooling channels 26. Respective support structures of the plurality of support structures 24 define respective contact surfaces 25 distal from substrate 30 or substrate 30*b*. Sacrificial composition 28 substantially fully fills the plurality of cooling channels 26 and leaves respective contact surfaces 25 substantially uncovered.

The example technique of FIG. 7 further includes casting cover layer 18 or 18*b* onto respective contact surfaces 25 of the plurality of support structures 24 (92). The casting may include introducing casting composition 86 into casting mold 84. In some examples, substrate 30 or 30*b* includes an alloy composition, and cover layer 18 or 18*b* includes the same alloy composition.

In some examples, casting cover layer 18 onto respective contact surfaces 25 includes positioning substrate 30, plurality of support structures 24, and sacrificial composition 28 in casting mold 84, and introducing casting composition 86 into casting mold 84 to contact at least a portion of casting core 82 (for example, casting core 12) comprising substrate 30 or 30*b* (92). In some examples, casting composition 86 is at a predetermined temperature that promotes bonding of cover layer 18 to respective contact surfaces 25. Casting composition 86 may be maintained at a temperature that promotes the formation of a microstructure or grain structure (for example by single crystal growth) that is substantially the same as in the material in substrate 30 or substrate 30*b*. For example, casting composition 86 may be maintained at a temperature between about 1300° C. (about 2370° F.) and about 1400° C. (about 2550° F.).

In some examples, the example technique of FIG. 7 includes, after casting cover layer 18 or 18*b* onto respective contact surfaces 25, substantially removing sacrificial composition 28 from the plurality of cooling channels 26 (94). For example, sacrificial composition 28 may be susceptible to at least one of leaching or oxidation. Substantially removing sacrificial composition 28 from the plurality of cooling channels 26 may include subjecting sacrificial composition 28 to at least one of a leaching composition or an oxidizing environment. For example, cast component 88 may be subjected to a post-casting treatment to remove sacrificial composition 28 from casting core 82. In some examples, sacrificial composition 28 may be susceptible (for example, by sufficiently breaking down or disintegrating) to one or both of leaching and oxidation. The post-casting treatment may include immersing cast component 88 in a volume of leaching composition, or subjecting cast component 88 to an oxidative environment. Cast component may optionally be rinsed or washed after the post-casting treatment. Sacrificial composition may thus substantially be removed from casting core 82 by the post-casting treatment.

In some examples, the example technique of FIG. 7 optionally includes, after casting cover layer 18 onto respective contact surfaces 25, forming the plurality of cooling apertures 34 in cover layer 18. For example, cooling apertures 34 may be machined by drilling cover layer 18. In some examples, cooling apertures 34 may be formed during the casting, for example, when cover layer 18*b* is cast onto casting core 12*b* such that protrusions 28*a* define cooling apertures 34.

In some examples, the example technique of FIG. 7 includes bonding substrate 30 or substrate 30*b* to a gas turbine engine component surface (96). For example, substrate 30 or substrate 30*b* may be bonded to a turbine shaft, a surface of a compressor section, or a surface of a combustor. In some examples, the example technique of FIG. 7 includes installing the gas turbine engine component in a gas turbine engine (98). For example, installing the gas turbine engine component may include connecting the component to an air-cooling system of the gas turbine engine.

Example gas turbine engine components including a cover layer, a cooling region, and a substrate have been described above. As described above, casting may be used to fabricate the example components. For example, example components may be fabricated using casting, for example, using the example system of FIGS. 6A, 6B, and 6C, or the example technique of FIG. 7, as discussed below. However, example systems described with reference to FIGS. 1A-2C above may be fabricated using other suitable example systems or other suitable example techniques.

Various examples have been described. These and other examples are within the scope of the following claims.

What is claimed is:

1. A method comprising:

filling a sacrificial composition in a plurality of cooling channels on a substrate, wherein a plurality of support structures integral with and extending from the substrate define the plurality of cooling channels, wherein respective support structures of the plurality of support structures define respective contact surfaces distal from the substrate, and wherein the sacrificial composition substantially fully fills the plurality of cooling channels and leaves the respective contact surfaces substantially uncovered; and casting a cover layer onto the respective contact surfaces of the plurality of support structures, wherein the substrate comprises a first alloy composition, wherein the cover layer comprises a second alloy composition, and wherein casting the cover layer onto the respective contact surfaces comprises:

positioning the substrate, the integral support structures, and the sacrificial composition in a casting mold; and introducing a molten casting composition into the casting mold to contact the molten casting composition to at least a portion of a casting core comprising the substrate.

2. The method of claim 1, wherein the first alloy composition is a same as the second alloy composition.

3. The method of claim 1, wherein the molten casting composition is at a predetermined temperature that promotes bonding of the cover layer to the respective contact surfaces.

4. The method of claim 1, further comprising, after casting the cover layer onto the respective contact surfaces, substantially removing the sacrificial composition from the plurality of cooling channels.

5. The method of claim 4, wherein the sacrificial composition is susceptible to at least one of leaching or oxidation, and wherein substantially removing the sacrificial composition from the plurality of cooling channels comprises subjecting the sacrificial composition to at least one of a leaching composition or an oxidizing environment.

6. The method of claim 1, further comprising, after casting the cover layer onto the respective contact surfaces, forming a plurality of cooling apertures in the cover layer.

7. The method of claim 1, further comprising installing a component comprising the substrate in a gas turbine engine.

8. The method of claim 7, wherein the installing the component includes connecting the component to an air-cooling system of the gas turbine engine.

9. The method of claim 1, wherein the substrate and the cover layer together form a dual-walled component.

10. The method of claim 1, wherein the substrate and the cover layer together form a flame tube, a combustion ring, a combustor casing, a combustor guide vane, a turbine vane, or a turbine blade.

11. The method of claim 1, wherein the cover layer defines a hot section surface defining a plurality of cooling apertures fluidly connected to the cooling channels.

12. The method of claim 1, wherein the sacrificial composition defines a protrusion protruding out a respective cooling channel of the plurality of cooling channels on the substrate, and wherein casting the cover layer onto the respective contact surfaces of the plurality of support structures comprises casting the cover layer onto the respective contact surfaces of the plurality of support structures such that the protrusion of the sacrificial composition protrudes through the cast cover layer.

13. The method of claim 12, further comprising, after casting the cover layer onto the respective contact surfaces, substantially removing the sacrificial composition from the plurality of cooling channels, wherein the removal of the sacrificial composition removes the protrusion that protrudes through the cast cover layer to define a cooling aperture in the cover layer.

* * * * *